US010926394B2

(12) United States Patent
Piras

(10) Patent No.: US 10,926,394 B2
(45) Date of Patent: Feb. 23, 2021

(54) HYDRAULIC PERCUSSION DEVICE

(71) Applicant: Montabert, Saint Priest (FR)

(72) Inventor: Bernard Piras, Vernaison (FR)

(73) Assignee: Montabert, Saint Priest (FR)

( * ) Notice: Subject to any disclaimer, the term of this patent is extended or adjusted under 35 U.S.C. 154(b) by 271 days.

(21) Appl. No.: 15/580,140

(22) PCT Filed: Jun. 6, 2016

(86) PCT No.: PCT/EP2016/062796
§ 371 (c)(1),
(2) Date: Dec. 6, 2017

(87) PCT Pub. No.: WO2016/198357
PCT Pub. Date: Dec. 15, 2016

(65) Prior Publication Data

US 2018/0297187 A1 Oct. 18, 2018

(30) Foreign Application Priority Data

Jun. 11, 2015 (FR) ..... 1555321

(51) Int. Cl.
*B25D 17/24* (2006.01)
*E02F 3/96* (2006.01)
*B25D 9/12* (2006.01)

(52) U.S. Cl.
CPC ..... *B25D 17/245* (2013.01); *B25D 9/12* (2013.01); *E02F 3/966* (2013.01); *B25D 2250/121* (2013.01)

(58) Field of Classification Search
CPC ..... B25D 9/12; B25D 9/125; B25D 9/145; B25D 17/24; B25D 17/245; B25F 5/006
(Continued)

(56) References Cited

U.S. PATENT DOCUMENTS 3,456,741 A * 7/1969 James ..... B25D 9/12 173/200
4,103,591 A * 8/1978 Reiersdal ..... B25D 9/145 91/39

(Continued)

FOREIGN PATENT DOCUMENTS

EP 2873489 A1 5/2015
WO WO-199306972 A1 4/1993

OTHER PUBLICATIONS

ISA European Patent Office, International Search Report and Written Opinion for corresponding International Application No. PCT/EP2016/062796, dated Aug. 8, 2016.

(Continued)

*Primary Examiner* — Dariush Seif
(74) *Attorney, Agent, or Firm* — Harris Beach PLLC

(57) ABSTRACT

The invention relates to a hydraulic percussion device intended to be fitted on a base vehicle, the device comprising: a housing comprising a closing plate; a power cell mounted in the housing; and a damper connecting the power cell and the closing plate, the damper comprising a body rigidly connected to the power cell opposite the closing plate; a chamber provided inside the body; and a closing piston which is movable inside the chamber and capable of abutting against the closing plate in order to seal the chamber, the chamber being intended to contain a compressible fluid for damping the movements of the power cell in relation to the housing.

9 Claims, 4 Drawing Sheets

(58) Field of Classification Search
USPC ..... 173/135, 124, 128, 133, 206, 210, 212
See application file for complete search history.

(56) References Cited

U.S. PATENT DOCUMENTS 4,380,901 A * 4/1983 Rautimo ..... B25D 9/12 60/418
4,466,493 A * 8/1984 Wohlwend ..... B25D 9/265 173/19
4,474,248 A * 10/1984 Musso ..... B25D 9/12 173/17
4,479,551 A * 10/1984 Justus ..... B25D 9/12 173/112
4,505,340 A * 3/1985 Yantsen ..... B25D 9/145 173/125
4,658,913 A * 4/1987 Yantsen ..... B25D 9/145 173/13
4,676,323 A * 6/1987 Henriksson ..... B25D 9/12 173/200
4,745,981 A * 5/1988 Buske ..... B25D 9/145 173/202
4,784,228 A * 11/1988 Ito ..... B25D 9/145 173/208
4,817,737 A * 4/1989 Hamada ..... B25D 9/145 173/115
4,852,664 A * 8/1989 Terada ..... B25D 9/12 173/206
4,880,213 A * 11/1989 Shinbori ..... F16F 9/0409 267/64.27
5,065,824 A * 11/1991 Ottestad ..... B25D 9/145 173/206
5,285,858 A * 2/1994 Okada ..... E02F 3/966 173/211
5,718,297 A * 2/1998 Weber ..... B25D 9/145 173/112
5,727,639 A * 3/1998 Jeter ..... B25D 9/04 173/126
5,893,419 A * 4/1999 Hodges ..... B25D 9/12 173/13
5,944,120 A * 8/1999 Barden ..... B25D 9/145 173/135
6,095,257 A * 8/2000 Lee ..... B25D 17/24 173/211
6,827,156 B1 * 12/2004 Hsiao ..... B25D 17/245 173/168
6,904,980 B2 * 6/2005 Rubie ..... B25B 27/02 173/128
7,055,319 B1 * 6/2006 Luca ..... F16F 9/088 60/475
7,152,692 B2 * 12/2006 Hurskainen ..... B25D 9/145 173/16
7,156,190 B2 * 1/2007 Ottestad ..... B25D 9/12 173/128
7,410,010 B2 * 8/2008 Henriksson ..... B25D 9/18 173/128
7,478,648 B2 * 1/2009 Lundgren ..... B25D 9/145 138/30
8,146,677 B2 * 4/2012 Kim ..... B25D 17/00 173/115
8,733,468 B2 * 5/2014 Teipel ..... B25D 9/12 173/135
2003/0047335 A1 * 3/2003 Nguyen ..... B23K 11/31 173/206
2006/0037845 A1 * 2/2006 Yoshimura ..... E04G 23/082 200/50.01
2007/0175647 A1 * 8/2007 Aoki ..... B25D 16/00 173/210
2008/0230248 A1 * 9/2008 Niu ..... B25D 9/125 173/206
2008/0283260 A1 * 11/2008 Kramer ..... B25D 17/06 173/128
2014/0262399 A1 * 9/2014 Cunningham ..... E04H 17/263 173/133
2015/0027569 A1 * 1/2015 Preuss ..... E02F 5/323 137/557
2016/0046009 A1 * 2/2016 Moore ..... B25D 9/08 184/6.14
2016/0288306 A1 * 10/2016 Pillers, II ..... B25D 9/06
2019/0344418 A1 * 11/2019 Liao ..... B25D 17/11

OTHER PUBLICATIONS

Zhang, Xincai, "Structural Principle and Maintenance of Hydraulic System of Imported Excavator," Jul. 31, 2008, Liaoning Science and Technology Press, pp. 269-273.

* cited by examiner

HYDRAULIC PERCUSSION DEVICE

CROSS-REFERENCE TO RELATED APPLICATIONS

This application is a national stage application under 35 U.S.C. § 371 of PCT Application No. PCT/EP2016/062796, filed on Jun. 6, 2016, which claims priority to and the benefit of French Application No. 1555321 filed on Jun. 11, 2015, which are incorporated herein by reference in their entirety.

TECHNICAL DOMAIN

The present invention relates to the domain of construction machinery. It concerns a hydraulic percussion device of the "rock breaker" or similar type.

PRIOR ART

As described in FIGS. 1 and 2 of the state of the art, hydraulic percussion devices 100 called "rock breakers" are generally composed of a body containing a power cell 140 and a housing 150, which enables the power cell 140 to be protected from the abrasive rocks, as well as to mechanically support the assembly in order to be able to hook it onto one end of an arm 12 of a carrier machine 11, for example a hydraulic excavator. The power cell 140 includes an impact piston 180 movable in a chamber so as to strike a tool 19 held in alignment with a lower end of the impact piston 180.

The movements of the impact piston 180 are controlled by two' opposing annular chambers 370, 380 supplied alternately by fluid under pressure. The power cell 140 also includes a compression chamber 220, containing a compressible gas, disposed above the impact piston 180. When the device 100 is actuated, a first phase consists of moving the impact piston 180 in the compression chamber 220 by application of a pressure in the lower annular chamber 380, thus compressing the gas in the compression chamber 220. A second phase consists of canceling the effect of the pressure in the lower annular chamber 380, by supplying the upper annular chamber 370 with the same pressure. The force then applied to the impact piston 180 depends on the difference in surface area between the annular chambers 370, 380 and this difference in surface area is small. In a third phase, the compressible gas is expanded, and it violently moves the impact piston 180 downwards, impacting the tool 19 with sufficient force to break a rock.

Thus, the pressure of the gas in the compression chamber 220 is very high. In order to contain this pressure, an upper end of the power cell 140 is sealed by a cover 240 secured to the uprights of the power cell 140 by a series of screws 310. This series of screws 310, which are disposed annularly, is necessary to maintain a seal of the compression chamber 220.

However, this solution is particularly complex to implement because of the high pressures on the cover 240. Thus, the thickness of the uprights of the power cell 140 must therefore be oversized to accommodate the series of screws 310. The screws 310 must be very long and of very high quality. The number of screws 310 required negatively impacts the weight of the hydraulic percussion device 100 as well as the time required to assemble the device.

Moreover, the arm 12 of the carrier machine 11 is movable so as to move the tool 19 against a surface S to be destroyed. To that end, the power cell 140 is mounted in a housing 150 which is attached to the arm 12 by a U-shaped attachment plate 160. The attachment plate 160 can be disposed on the side of the housing 150, or on a cover 200 of the housing 150 as illustrated in FIG. 2. The force of the arm 12 of the carrier machine 11 is transmitted to the tool 19 by bearing means 260 on the tool 19 secured in the power cell 140;

When the hydraulic percussion device 100 strikes a surface S to be destroyed, it transmits a compression wave F onto this surface S in the direction of movement of the tool 19. This wave F can induce a reflected shockwave R in the opposite direction of the wave F generated by the impact piston 180. This reflected shockwave R is transmitted to the entire power cell 140 by the bearing means 260 of the tool 19. To prevent transmitting said resultant shockwave R to the arm 12 of the carrier machine 11, the power cell 140 is mounted in the housing 150 between two suspensions, an upper 280 and a lower 281. The movements of the power cell 140 relative to the housing 150 are guided by guide means 290 disposed along the housing 150.

This solution also has a disadvantage related to the upper and lower suspensions 280, 281. These elastic assemblies must withstand heat, oil and grease, thrust forces from the carrier machine 11 and the forces induced by the reflected wave R. These are wearing parts that are expensive and have a short working life. Furthermore, wedging must frequently be provided to obtain a specific pre-compression of the upper suspension 280 to keep the closing plate 200 closing the housing 150.

An object of the invention is to find a solution enabling a power cell 140 to be installed in a housing 150 without having to use a complex and costly suspension.

DESCRIPTION OF THE INVENTION

The present invention seeks to resolve this technical problem by a suspension achieved by a closing piston that is movable in a chamber containing a compressible fluid.

To that end, the invention concerns a hydraulic percussion device intended to be installed on a carrier machine, the device comprising:

- a housing comprising a closing plate,
- a power cell mounted in the housing comprising an impact piston that is movable in translation, and
- a damper connecting the power cell and the closing plate in such a way as to transmit the displacement forces applied on the housing to the power cell, the damper comprising:
- a body rigidly connected to the power cell opposite the closing plate,
- a chamber provided inside the body, and
- a closing piston which is movable inside the chamber and capable of abutting against the closing plate in order to seal the chamber,
- the chamber being intended to contain a compressible fluid capable of damping the movements of the power cell relative to the housing.

Thus, the invention makes it possible to reproduce more simply the role of the cover and suspensions of the prior art by a closing piston that is movable in a chamber containing a compressible fluid. The power cell can thus be made lighter compared to devices of the prior art by reducing the thickness of the uprights of the power cell and eliminating the screws and cover. The damping of the movements of the power cell relative to the housing and of the housing relative to the power cell is also improved, which enables the lower suspension to be eliminated.

The device according to the invention can be integrated in various configurations.

According to a first embodiment, at least one portion of the impact piston is intended to penetrate into the chamber in such a way that, when the chamber contains a compressible fluid, the displacement of the impact piston inside the chamber is capable of compressing the compressible fluid, and the decompression of the compressible fluid is capable of displacing the impact piston. Thus, the damper also serves as actuator for the impact piston. This embodiment makes it possible to eliminate the closing cover of the power cell, thus simplifying and lightening the device.

According to a second embodiment, the power cell is connected to a pressure accumulator comprising a hydraulic circuit and a pneumatic circuit separated by a deformable membrane, the chamber is in pneumatic communication with the pneumatic circuit of the pressure accumulator so that the pressure contained in the hydraulic circuit is transmitted to the chamber by means of said membrane. In this case, the damper also plays the role of pressure accumulator, to withstand the hammer blows or the strong variations in pressure generated by the power cell. This embodiment also makes it possible to eliminate the closing cover of the power cell, thus simplifying and lightening the device.

According to a third embodiment, the power cell being sealed by a cover, the body comprising the chamber is mounted on said cover.

In this embodiment, the damper is hydraulically independent of the moving members of the impact piston. This embodiment makes it possible to limit the pressures on the cover of the actuating chamber.

According to one embodiment, the closing piston comprises:

a body, intended to ensure the sealing of the chamber, and a head, intended to ensure that the closing piston is maintained against the closing plate. Advantageously, the body of the closing piston comprises a groove containing a gasket appropriate for the diameter of the chamber and for an expected pressure in the chamber. This embodiment makes it possible to ensure the sealing of the chamber of the damper.

Advantageously, in practice the chamber is intended to contain nitrogen in gaseous form. This embodiment makes it possible to respond effectively to the compression and expansion stresses of the compressible fluid.

According to one embodiment, the device comprises an element for rigidly attaching the housing to the closing plate, the attachment element being intended to attach the housing to a carrier machine. Alternatively, the attachment element is positioned on the housing in an area away from the closing plate.

BRIEF DESCRIPTION OF THE FIGURES

The way to achieve the invention as well as the advantages deriving therefrom will be clearly seen from the following embodiment, provided by way of non-limiting example, as a function of the appended figures in which

FIG. 1, state of the art: a schematic representation in perspective of a carrier machine equipped with a hydraulic percussion device;

FIG. 2, state of the art: a schematic representation in cross-section of the hydraulic percussion device of FIG. 1;

FIG. 3: a schematic representation in cross-section of a hydraulic percussion device according to a first embodiment of the invention;

FIG. 4: a schematic representation in cross-section of a hydraulic percussion device according to a second embodiment of the invention;

FIG. 5: a schematic representation in perspective of the hydraulic percussion device of FIG. 4;

FIG. 6: a schematic representation in perspective of a power cell according to the embodiment of FIG. 4.

DETAILED DESCRIPTION OF THE INVENTION

Figure 1:
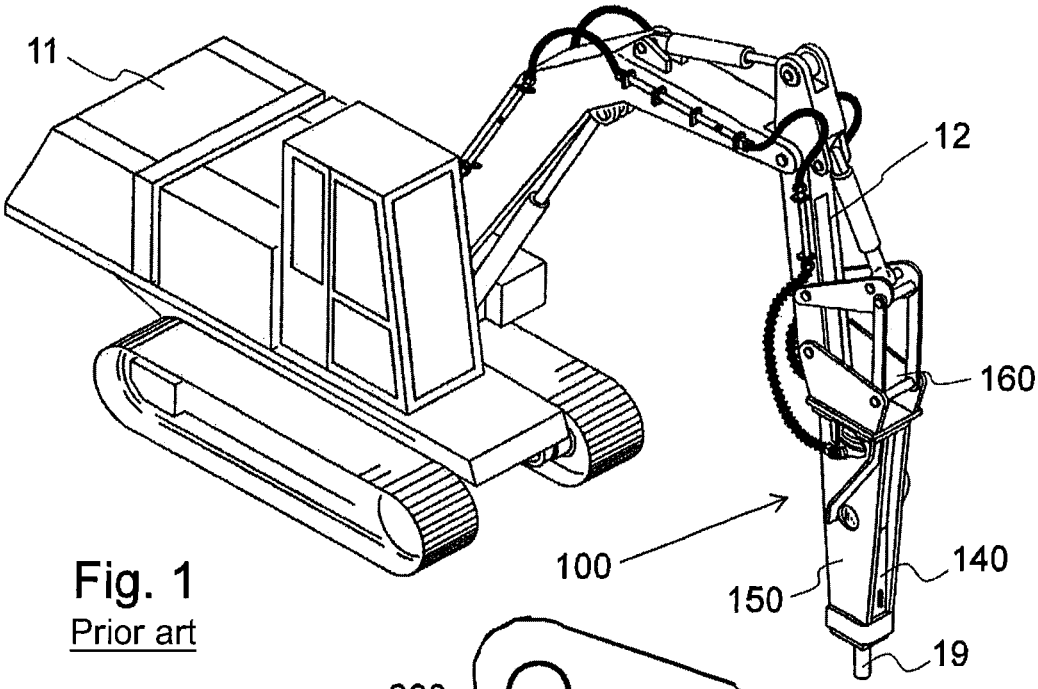
Fig. 1 Prior art
FIGS. 1 to 6 represent.
Figure 2:
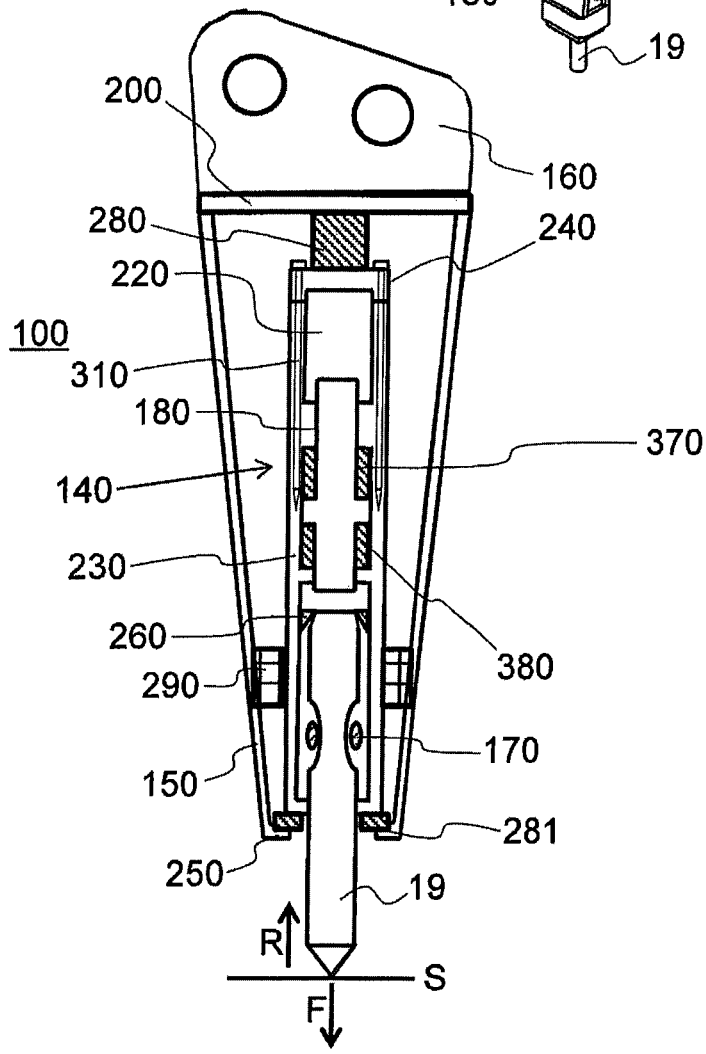
Fig. 2 Prior art

In the description, the hydraulic percussion device 10*a*, 10*b*, 10*c* is described assuming that it is positioned in its most common configuration, namely vertically, i.e. with the tool 19 oriented vertically in contact with a surface to be destroyed, as illustrated in FIG. 1.

Figure 3:
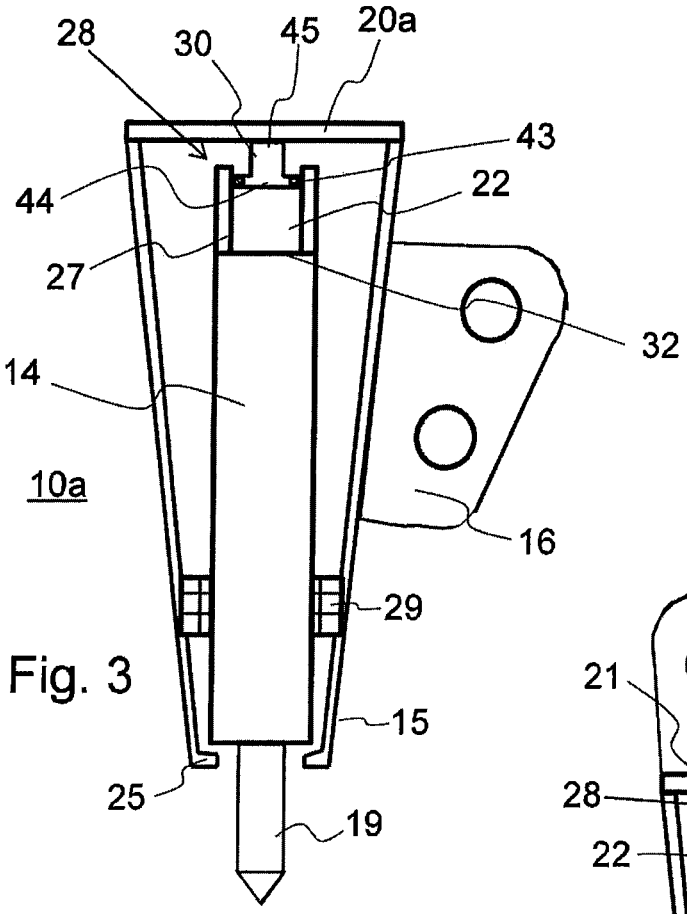

FIG. 3 illustrates a hydraulic percussion device 10*a* comprising a housing supporting a power cell 14. The power cell 14 is substantially cylindrical or parallelepiped in shape, sealed by a cover 32. The power cell 14 is mounted inside the housing 15 between a damper 28, guide means 29 and a stop 25. A U-shaped attachment plate 16 is disposed on the side of the housing 15 to attach the housing to the arm 12 of a carrier machine 11. As a variant, as described in FIGS. 4 to 7, the attachment plate 16 can be disposed on the upper part of the housing 15.

The housing 15 comprises a closing plate 20*a* attached to the uprights surrounding the power cell 14. The damper 28 is positioned between said closing plate 20*a* and the cover 32 of the power cell 14. Said damper 28 comprises a body 27 rigidly connected to the power cell 14 opposite the closing plate 20*a*. By "rigidly connected," it is understood that the body 27 is attached directly or indirectly to the power cell 14. A chamber 22 is provided inside the body 27, and a closing piston 30 is mounted movable in translation in the chamber 22. The body 27 and the chamber 22 are preferably cylindrical. The closing piston 30 is dimensioned to ensure the seal of the chamber 22. For example, as illustrated in FIG. 3, the closing piston 30 can comprise a body 44 and a head 45 that are cylindrical. The diameter of the body 44 is adapted to the diameter of the chamber 22 so as to ensure the seal of the chamber 22. Preferably, the body 44 comprises a groove containing a gasket 43 suitable for the diameter of the chamber 22.

The chamber 22 is intended to contain a compressible fluid, for example nitrogen in gaseous form. The head 45 of the closing piston 30 is pressed against the closing plate 20*a* when the chamber 22 is under pressure. The compressible fluid is intended to dampen the movements of the power cell 14 relative to the housing 15, for example when a reflected shockwave is transmitted to the power cell 14 by the tool 19. The compressible fluid can also dampen the movements of the housing 15 relative to the power cell 14, for example when an abrupt movement of the tool 19 is controlled by the arm 12 of a carrier machine 11.

In the first embodiment of FIG. 3, the impact piston 18 contained in the power cell 14 is movable in an actuation chamber different from the chamber 22 of the damper 28. In the second embodiment of FIGS. 4 to 6, the actuation chamber of the impact piston 18 and the chamber 22 of the damper 28 are achieved by a single through-bore in the power cell 14. The body 23 of the power cell 14 is combined with the body 27 of the damper 28. From bottom to top, the body 23 of the power cell 14 contains a portion of the tool 19, the impact piston 18 and a portion of the closing piston 30. These two elements are movable in the chamber 22 and extend longitudinally along the same axis X.

The tool 19 comprises an upper end intended to receive impacts from the impact piston 18. The shockwave is propagated along the body of the tool 19 down to the lower end intended to come in contact with the surface S to be destroyed. The body of the tool 19 is preferably cylindrical with a flattened surface in which two retainer keys 17 are disposed. The retainer keys 17 are connected to the power cell 14 in such a way as to limit the rotational and translational movements of the tool 19. The retainer keys 17 also make it possible to maintain the tool 19 in the power cell 14 during movements of the hydraulic percussion device 10*b* and when the tool 19 is not in contact with a surface S to be destroyed. The arm 12 of a carrier machine 11 can also press down on the tool 19. To do this, the arm 12 moves the housing 15, thus causing a movement of the power cell 14. Bearing means 26 on the tool 19 are also secured in the body 23 of the power cell 14 at a beveled surface of the tool 19 so as to transmit the movements of the power cell 14 to the tool 19.

The impact piston 18 is movable in the body 23 of the power cell 14 by means of two opposing annular chambers 37, 38 alternately supplied by fluid under pressure. The two chambers 37, 38 are controlled by a hydraulic control device 41. The power cell 14 also includes a compression chamber, containing a compressible gas, disposed above the impact piston 18. The compression chamber is combined with the chamber 22 of the damper 18. The same compressible gas, for example nitrogen, is used to carry out the function of the compression chamber and the function of the damper 18.

When the hydraulic percussion device 10*b* is actuated, a first phase consists of moving the impact piston 18 in the chamber 22 by injection of a pressure into the lower annular chamber 38, thus compressing the gas in the chamber 22. A second phase consists of canceling the effect of the pressure in the lower annular chamber 38, by supplying the upper annular chamber 37 with the same pressure; thus, there is then nearly no force applied to the impact piston 18 by the annular chambers 37, 38. In a third phase, the compressible gas is expanded, and it violently moves the impact piston 18 downwards, impacting the tool 19 with sufficient force to break a rock.

The damper 28 comprises a body 27 combined with the body 23 of the power cell 14 and a closing piston 30 movable in translation in the body 23. The closing piston 30 comprises a body 44 the diameter of which is adapted to the diameter of the chamber 22. Said body 44 is provided with an annular groove in which a gasket 43 is inserted, ensuring the seal of the chamber 22. The closing piston 30 comprises a head of one piece with the body 44. The head 45 is intended to come into contact with a closing plate 20*b*. The closing piston 30 thus makes it possible to effectively seal the chamber 22 and lock the power cell 14 in the housing 15.

Preferably, the closing piston 30 is dimensioned in such a way that when the chamber 22 is under pressure, the pressure of the chamber 22 on the closing piston 30 is greater than the force of pressure of the arm 12 of the carrier machine 11 on the closing plate, irrespective of the position of the impact piston 18.

Figure 4:
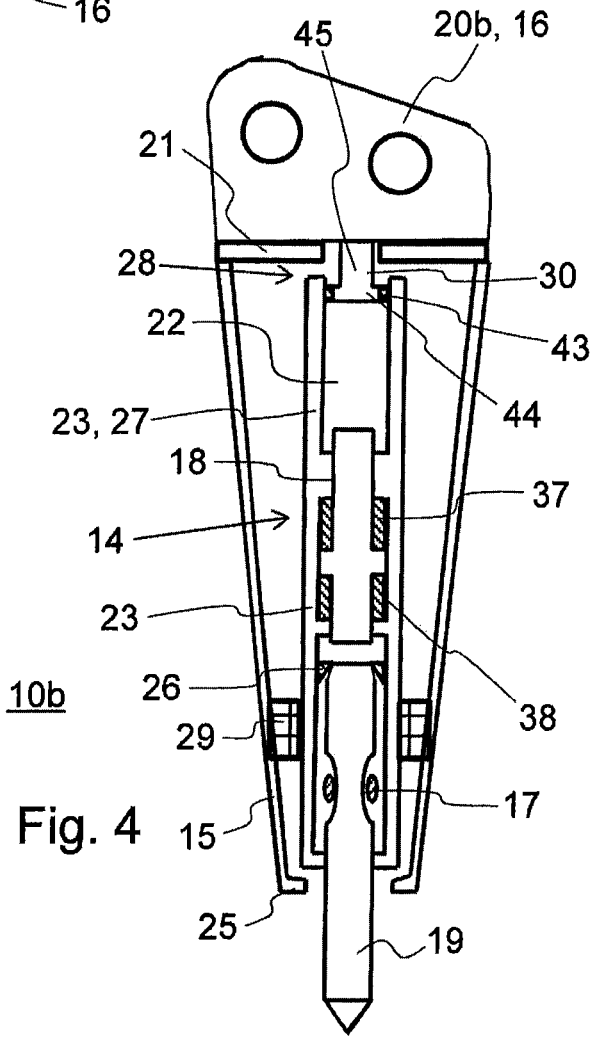
Figure 5:
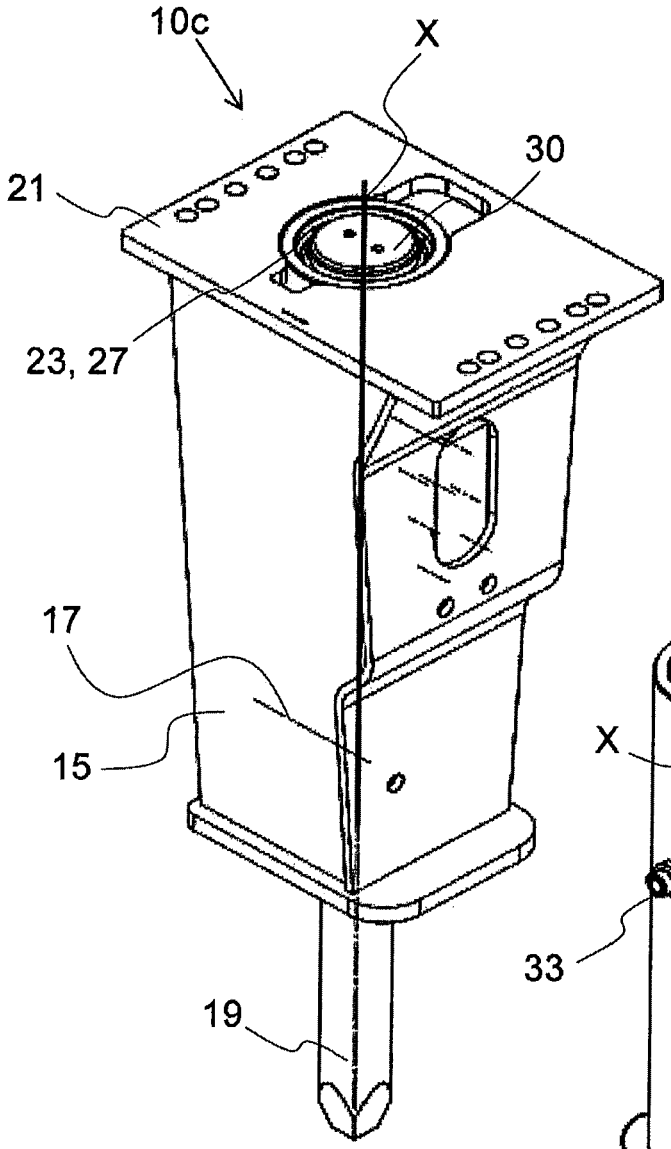
Figure 6:
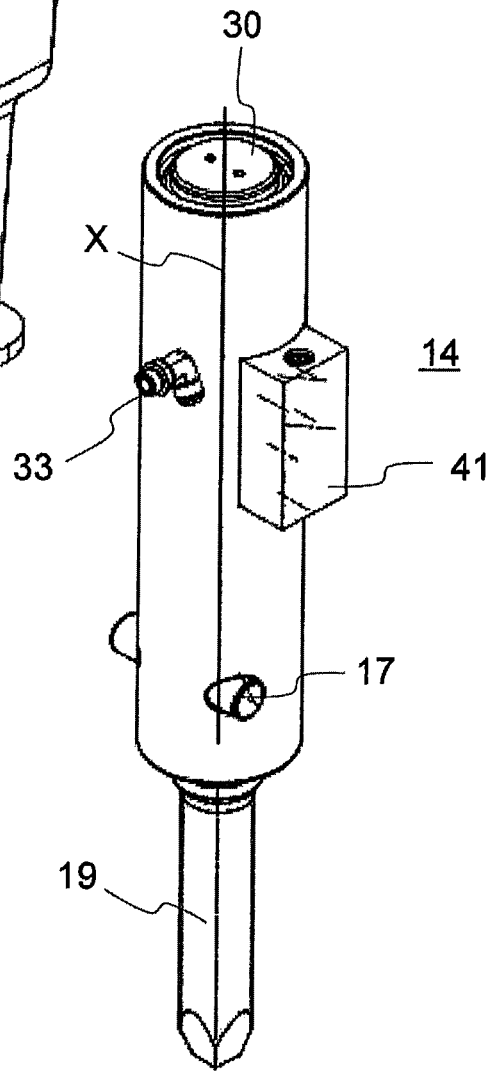

In the example of FIGS. 4 to 6, the closing plate 20*b* is formed by the attachment plate 16 intended to be attached to the arm 12 of a carrier machine 11. The housing 15 comprises an attachment plate 21 intended to cooperate with the attachment plate 16 to attach the hydraulic percussion device 10*b* to the arm 12 of a carrier machine 11. The attachment plate 21 of the housing 15 comprises a central recess in which the head 45 of the closing piston 30 penetrates in order to enter into contact with the attachment plate 16.

To assemble the hydraulic percussion device 10*b*, the tool 19, the impact piston 18 and the closing piston 30 are inserted successively into the body 23 of the power cell 14. After insertion of the tool 19, the retaining keys 17 are inserted to restrict the rotational and translational movements of the tool 19. The impact piston 18 is moved in the body 23 abutted against the tool 19, so that the chambers 37, 38 can control the movements of the impact piston 18. The closing piston 30 is then inserted into the body 23 above the impact piston 18. The attachment plate 21 of the housing 15 is attached to the attachment plate 16 intended to be attached to the arm 12 of a carrier machine 11. Finally, the gas is then introduced into the chamber 22 through a fluid intake 33, moving the closing piston 30 against the attachment plate 16.

Figure 7:
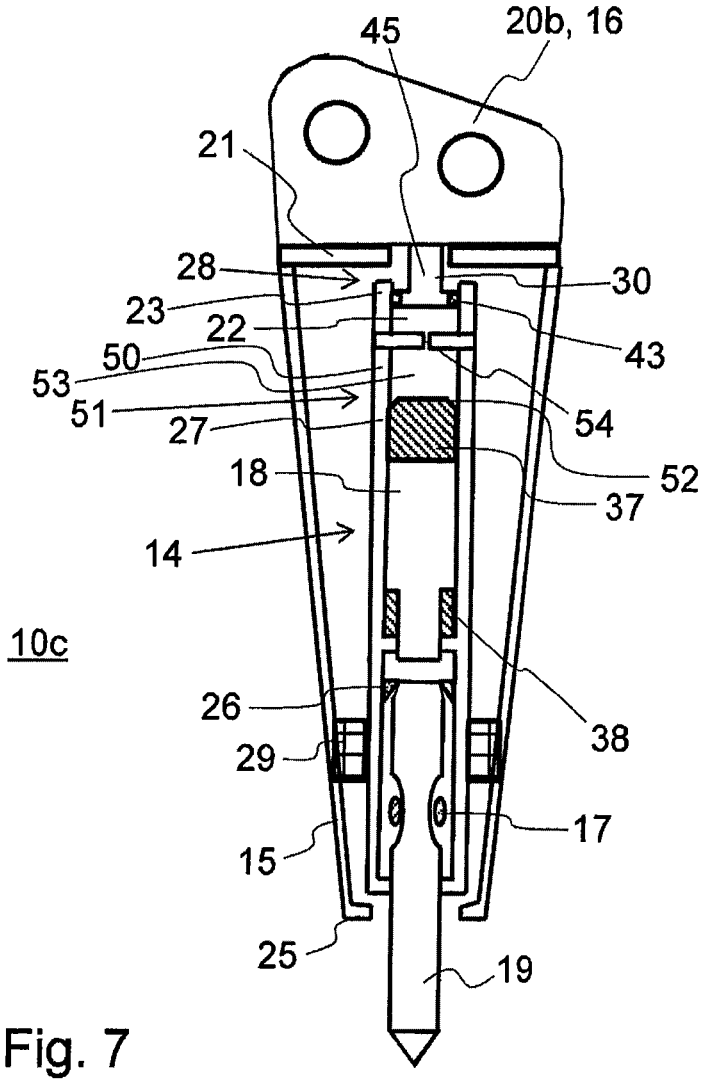
FIG. 7: a schematic representation in cross-section of a hydraulic percussion device according to a third embodiment of the invention.

In the example of FIG. 7, a hydraulic percussion device 10*c* comprises an upper chamber 37 to control the impact piston 18, said chamber being disposed above the impact piston 18 in a pressure accumulator 51. The pressure accumulator 51 comprises a pneumatic circuit 53 disposed above the upper chamber 37. The pneumatic circuit 53 and the upper chamber 37 are connected by a deformable membrane 52 in such a way that the variations of pressure of the upper chamber 37 are absorbed by the pneumatic circuit 53 by means of the deformable member 52. The damper 28 is disposed on the pressure accumulator 51 and the chamber 22 of the damper 28 is in pneumatic communication with the pneumatic circuit 53 of the pressure accumulator 51 by means of a channel 54. Thus, the variations in pressure of the upper chamber 37 are absorbed both by the pneumatic circuit 53 and by the damper 28.

It is clear from the foregoing that the hydraulic percussion devices 10*a*, 10*b*, 10*c* according to the invention have multiple advantages, particularly in terms of ease of assembly, compensation for manufacturing tolerances, and simplicity related to the elimination of the additional suspension device.

The invention claimed is:

1. A hydraulic percussion device intended to be installed on a carrier machine, the device comprising:

a housing comprising a closing plate, a power cell mounted in the housing and movable in translation relative to said housing; said power cell comprising an impact piston that is movable in translation by two opposing annular chambers alternately supplied by fluid under pressure, and a damper connecting the power cell and the closing plate in such a way as to transmit the displacement forces applied on the housing to the power cell, wherein the damper comprises:

a body rigidly connected to the power cell opposite the closing plate, said body being immobile relative to said power cell, a chamber provided inside the body, and a closing piston which is movable inside the chamber and relative to said power cell and capable of abutting against the closing plate in order to seal the chamber, said closing piston being pressed against said closing plate when said chamber is under pressure, the chamber being intended to contain a compressible fluid for damping the movements of the power cell in relation to the housing.

2. The device according to claim 1, wherein at least one portion of the impact piston is intended to penetrate into the chamber in such a way that, when the chamber contains a compressible fluid, the displacement of the impact piston inside the chamber is capable of compressing the compressible fluid, and the decompression of the compressible fluid is capable of displacing the impact piston.

3. The device according to claim 1, wherein the power cell is connected to a pressure accumulator comprising a hydraulic circuit and a pneumatic circuit separated by a deformable membrane, the chamber is in pneumatic communication with the pneumatic circuit of the pressure accumulator so that the pressure contained in the hydraulic circuit is transmitted to the chamber by means of the membrane.

4. The device according to claim 1, wherein the power cell being sealed by a cover, the body comprising the chamber is mounted on said cover.

5. The device according to claim 1, wherein the closing piston comprises:

a body, intended to ensure the sealing of the chamber, and, a head, intended to ensure that the closing piston is maintained against the closing plate.

6. The device according to claim 5, wherein the body of the closing piston comprises a groove containing a gasket appropriate for the diameter of the chamber and for an expected pressure in the chamber.

7. The device according to claim 1, wherein the chamber is intended to contain nitrogen in gaseous form.

8. The device according to claim 1, further comprising an element for rigidly attaching the housing to the closing plate, the element being intended to attach the housing to a carrier machine.

9. The device according to claim 1, further comprising an attachment element positioned on the housing in an area away from the closing plate, the attachment element being intended to attach the housing to a carrier machine.

* * * * *